US005327111A

United States Patent [19]

Gipprich

[11] Patent Number: 5,327,111

[45] Date of Patent: Jul. 5, 1994

[54] MOTION INSENSITIVE PHASE COMPENSATED COAXIAL CONNECTOR

[75] Inventor: John W. Gipprich, Millersville, Md.

[73] Assignee: Westinghouse Electric Corp., Pittsburgh, Pa.

[21] Appl. No.: 945,567

[22] Filed: Sep. 16, 1992

[51] Int. Cl.[5] ..... H01P 1/04

[52] U.S. Cl. ..... 333/260; 439/578

[58] Field of Search ..... 333/260; 439/578

[56] References Cited

U.S. PATENT DOCUMENTS 3,089,105 5/1963 Alford ..... 333/260 X
3,309,632 3/1967 Trudeau ..... 333/260 X
3,568,111 3/1971 Dyer et al. ..... 333/260
4,358,174 11/1982 Dreyer ..... 439/249
4,779,006 10/1988 Chapell ..... 333/105
5,120,705 6/1992 Davidson et al. ..... 333/260 X

*Primary Examiner*—Paul Gensler

[57] ABSTRACT

In a motion insensitive coaxial cylindrical connector a male member has a substantially cylindrical body having a male or diameter and a substantially cylindrical stub having a minor diameter which stub extends from the body of the male member. The stub fits into a dielectric sleeve within a cavity in a female member. Preferably, the dielectric sleeve has two portions made of different dielectric materials.

9 Claims, 2 Drawing Sheets

MOTION INSENSITIVE PHASE COMPENSATED COAXIAL CONNECTOR

BACKGROUND OF THE INVENTION

1. Field of the Invention

The invention relates to a connector for coaxial cable.

2. Background of the Invention

Two piece connectors of the type having a male member which fits into a female member have long been used for connecting cables and other conductors. This type of connector can be easily connected and disconnected. Such a connector and other connectors designed for easy connect/disconnect operations, have the disadvantage that motion between the connector pairs is possible if both ends of the pair are not securely mounted. With this motion the electrical characteristics of the connector may vary sufficiently to degrade system performance. For example, phase modulation sidebands caused by mechanical vibrations (or other causes) are typically required to be below −110 dBc for many modern radar systems. To meet this requirement, using conventional connectors, the relative movement between connector pairs would need to be kept to less than $10^{-6}$ wavelengths. At 10 GHz, this distance is about 1.2 microinches. The present approach to solving the modulation problem is to mount both ends of the connector pair in such a way as to virtually eliminate the relative motion between the connector ends or to reduce this motion to below some acceptable level. This approach, however, may not be possible for some mechanical structures or may be too difficult or expensive to implement. Thus, there is a need for a connector that is insensitive to this motion. Such a connector must be designed not to produce phase shifts as the connector pair separates.

SUMMARY OF THE INVENTION

I have developed a motion insensitive coaxial connector with a center conductor having a male member which fits into a cavity within the female member. I provide a dielectric sleeve which fits within the cavity and into which the male member is inserted. I prefer, however, to provide a dielectric sleeve comprised of two portions having different dielectric loading constants. One such portion could be air. When the male member is inserted into the female member a first portion of the male member will be within the first portion of the dielectric sleeve thereby causing a first characteristic impedance, and a second portion of the male member will be within the second portion of the sleeve causing a second characteristic impedance. A third portion of the male member will be outside of the sleeve, causing a third characteristic impedance. The relationships between the three characteristic impedances and the lengths of the two portions of the dielectric sleeve result in a phase shift of the transmitted signal which does not change as the length of the third portion of the male member changes.

I further prefer to select the loading constants so that the sleeve, male member and female member are convenient dimensions.

Other objects and advantages of the subject invention will become apparent from the following detailed description of certain present preferred embodiments as shown in the drawings.

DESCRIPTION OF THE PREFERRED EMBODIMENTS

Figure 1:
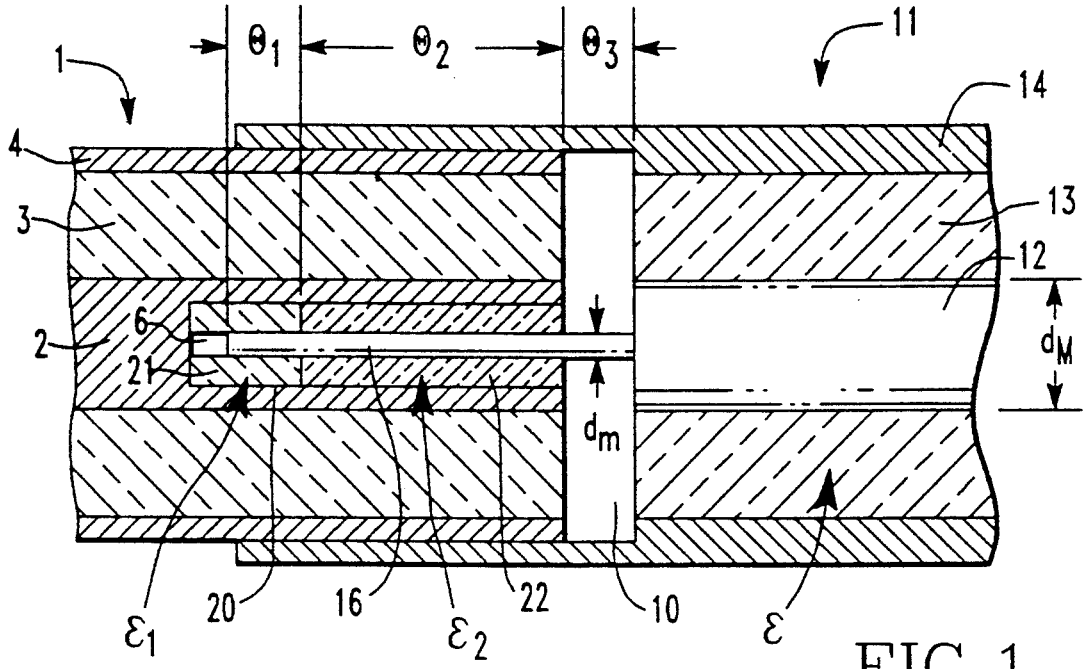
FIG. 1 is a cross sectional view of a first present preferred embodiment of my connector.
Figure 2:
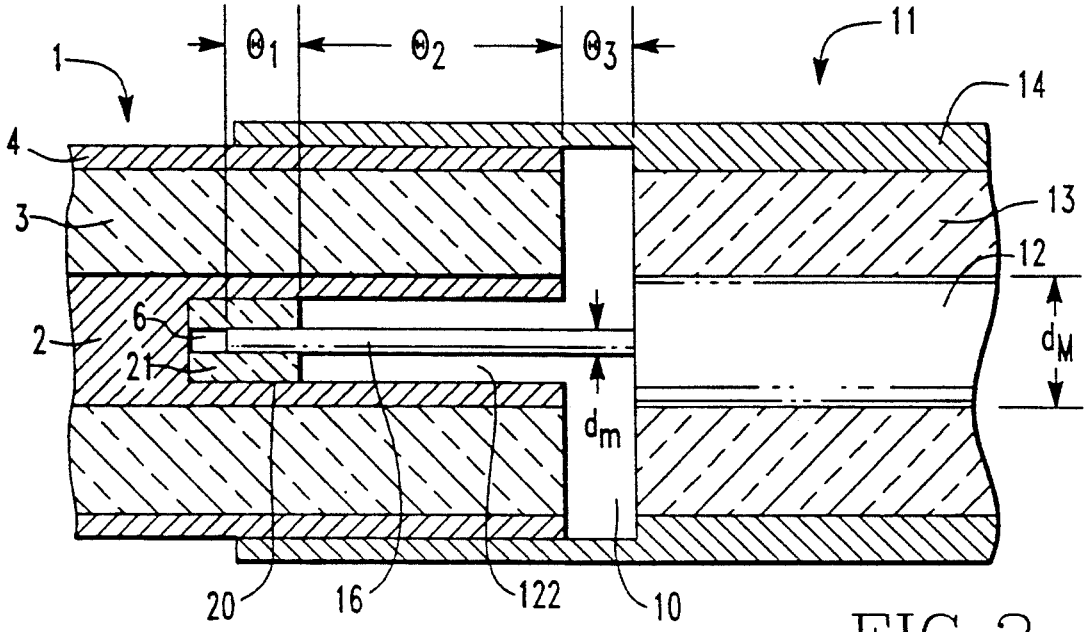
FIG. 2 is a cross sectional view of the second present preferred embodiment of my connector.

Referring to FIGS. 1 and 2 all embodiments of my connector are comprised of a female member 1 and male member 11. The female member has a center conductor 2 surrounded by a dielectric 3 and an outer conductor 4. A cavity 6 is provided within the center conductor 2. Male member 11 is also constructed of a center conductor body 12 surrounding by a dielectric 13 and outer conductor 14. A stub 16 extends from the center conductor body 12 of male member 11 and fits into cavity 6. For purposes of illustration, all embodiments are shown with a gap 10 between the end of the center conductor body 12 of the male member 11 and the end of the center conductor 2 of the female member 1. When male member 11 is inserted into female member 1, the two elements would be pressed tightly together so that gap 10 would be very small. However, vibrations and other forces acting on the connector may cause the male member 11 to move away the female member 1 increasing the size of gap 10.

In the embodiment of FIG. 1 I provide a dielectric sleeve 20 having a first portion 21 and a second portion 22. The first portion is made of a dielectric material having dielectric constant $\epsilon_1$. The sleeve has a second portion 22 made of a dielectric material having a dielectric constant $\epsilon_2$. The embodiment of FIG. 2 is similar to the embodiment of FIG. 1 except that second portion 22 is not used and region 122 is air. When the male member 11 is inserted into the female member 1 as shown in FIG. 1 a portion of stub 16 will be within the first portion 21 of the dielectric sleeve 20. A second portion of stub 16 will be within the second portion 22 of the dielectric sleeve and a third portion of the stub will be within gap 10. The length of these respective portions of stub 16 are identified by $\theta_1$, $\theta_2$ and $\theta_3$. The characteristic impedances of the respective portions of the stub 16 are identified by $Z_1$, $Z_2$, and $Z_3$, respectively.

The conductor body 12 of male member 11 has a major diameter $d_M$. The stub 16 has a smaller minor diameter $d_m$. There will be a high impedance present where stub 16 meets conductor body 12. A low impedance will occur at the distal end of stub 16. Preferably the length of stub 16 will be $\frac{1}{4}$ of a wave length of the signal intended to pass through conductor body 12.

A material having a high dielectric constant ($\epsilon_1$) is used for first portion 21 to provide a low impedance and a high sensitivity to changes in length. In the second portion 22 of the sleeve the dielectric constant ($\epsilon_2$) of the material is chosen to properly transform the low impedance at the end of the stub to the required high impedance at the input of the stub. I prefer the length of the portion 22 to be close to but less than $\frac{1}{4}$ wavelength, and the length of portion 21 should be small. The particular choice of dielectrics depends upon the desired band width as well as to achieve convenient dimensions. An impedance match at the band center is achieved if the lengths are chosen:

$$\tan\theta_1 \tan\theta_2 = (\epsilon_2/\epsilon_1)^{\frac{1}{2}}$$

When the male member is separated from the female member the length $\theta_1$ of the portion of stub 16 within the first portion 21 of sleeve 20 decreases. In use a portion of stub 16 should remain within the first portion 21 of sleeve 20. Therefore, as the connector moves the portion $\theta_2$ of stub 16 within second portion 22 of sleeve 20 remains constant. At the same time the portion of the stub $\theta_3$ within gap 10 continues to increase. This can be expressed mathematically if we consider $\theta_1$ to have an initial value, $\theta_{10}$.

$\theta_1 = \theta_{10} - \sqrt{\epsilon_1}\theta_3$, i.e. as the center conductor moves towards the right, $\theta_3$ increases in electrical length and $\theta_1$ decreases in electrical length by $\sqrt{\epsilon_1}\theta_3$ from its initial value of $\theta_{10}$. The impedance of the portion of the open circuited stub in dielectric $\epsilon_1$ is:

$$\begin{aligned} Z_s &= -i\,Z_1 \cot\theta_1 \\ &= -i\frac{Z_{01}}{\sqrt{\epsilon_1}} \cot(\theta_{10} - \sqrt{\epsilon}\ \theta_3) \end{aligned}$$

where $Z_{01}$ is the characteristic impedance of the coaxial section with the center conductor cavity filled with air, i.e. [$Z_{01} = 138 \log (b/a)$] where b is the diameter of outer conductor 2 and a is the diameter of the inner conductor which is stub 16.

Assuming for the purposes of discussion that $\theta_2$ is equal to a quarter-wavelength, then $Z_S$ is transformed by $$\begin{aligned} (Z_s)_{IN} &= \frac{Z_2^2}{-i\,Z_1 \cot\theta_1} \\ &= i\frac{Z_2^2}{Z_1}\tan\theta_1 \\ &= i\frac{\left(\frac{Z_{01}^2}{\epsilon_2}\right)}{\frac{Z_{01}}{\sqrt{\epsilon_1}}}\tan(\theta_{10} - \sqrt{\epsilon_1}\ \theta_3) \\ &= Z_{01}\frac{\sqrt{\epsilon_1}}{\epsilon_2}\tan(\theta_{10} - \sqrt{\epsilon_1}\ \theta_3) \end{aligned}$$

$$\begin{aligned} \tan(\theta_{10} - \sqrt{\epsilon_1}\ \theta_3) &= \frac{\tan\theta_{10} - \tan\sqrt{\epsilon_1}\ \theta_3}{1 + \tan\theta_{10}\tan\sqrt{\epsilon_1}} \\ &\approx \tan\theta_{10} - \tan\sqrt{\epsilon_1}\ \theta_3 \\ &\approx \tan\theta_{10} - \sqrt{\epsilon_1}\ \tan\theta_3 \end{aligned}$$

for small $\theta_{10}$ and $\sqrt{\epsilon_1}\ \theta_3$ $$\therefore (Z_S)_{IN} = iZ_{01}\frac{\sqrt{\epsilon_1}}{\epsilon_2}[\tan\theta_{10} - \sqrt{\epsilon_1}\ \tan\theta_3]$$

Assume for the moment that $\theta_{10} = 0$ $$\text{Then } (Z_s)_{IN} = iZ_{01}\left(\frac{\epsilon_1}{\epsilon_2}\right)\tan\theta_3$$

-continued $$\text{If } \epsilon_1 = \epsilon_2 \text{ then}$$

$$(Z_s)_{IN} = iZ_{01}\tan\theta_3$$

It can be shown that for $\epsilon_1 = \epsilon_2$ and $\theta_1 + \theta_2 = 90° - \theta_3$, the condition for constant transmission phase is $$Z_{01} = \frac{Z_3^2 + 1}{Z_3}$$

$$\therefore (Z_s)_{IN} = i\left(\frac{Z_3^2 + 1}{Z_3}\right)\tan\theta_3$$

To meet the conditions for constant transmission phase for $\epsilon_1 \neq \epsilon_2$ then $$Z_{01}\left(\frac{\epsilon_1}{\epsilon_2}\right) = \frac{Z_3^2 + 1}{Z_3}$$

or $$Z_{01} = \left(\frac{\epsilon_2}{\epsilon_1}\right)\frac{Z_3^2 + 1}{Z_3}$$

Therefore, we can use $\epsilon_2$ and $\epsilon_1$ to adjust $Z_{01}$ to have convenient dimensions.

For example, I may chose $\epsilon_1 = 9$ and $\epsilon_2 = 1$, $Z_3 = 2.5$ (125 ohms, unnormalized) for a 50 ohm connector.

$$\begin{aligned} Z_{01} &= \left(\frac{Z_3^2 + 1}{Z_3}\right)\left(\frac{\epsilon_2}{\epsilon_1}\right) = \left(\frac{(2.5)^2 + 1}{2.5}\right)\frac{1}{9} = 0.3272 \\ &= 16.111 \text{ ohms (unnormalized) for a 50 ohm connector.} \end{aligned}$$

In practice we really can't have $\theta_{10} = 0$ because this would result in the stub 16 moving into the $\epsilon_2$ region as $\theta_3$ increases. This would reduce to a single dielectric situation resulting in awkward dimensions. To overcome this problem, I made $\theta_2 = 80°$ and $\theta_{10} = 3.3637°$. As $\theta_3$ increases by one degree, $\theta_1$ decreases by $\sqrt{\epsilon_1}\theta_3$ or 3°, i.e. $\theta_1$ changes from 3.3637° to 0.3637°.

A prototype connector of the type shown in FIG. 2 was produced under my direction. The connector had a Delrin dielectric (Er = 3.8) for the first portion 21 of the sleeve. Region 122 adjacent sleeve portion 21 was filled with air. The dimensions of $d_m$ and $d_M$ were made equal to 32 mils and 64 mils respectively. The stub extended 10 mils into the first portion 21 in its initial position. The length of $\theta_2$ of the air filled section was 264 mils long. The characteristic impedance of the stubs are 39.7 ohms in the air filled section 122 and 22.2 ohms in the Delrin section 21. The 50 ohms sections 13 and 3 of the connector are air filled with inner and outer diameter dimensions of 65 mils and 150 mils respectively.

Table 1 shows the computed results of the prototype connector. The connector was designed to operate at a center frequency of 10 GHz. The 20 db return loss (Voltage Standing Wave Ratio (V.S.W.R.) = 1.22) bandwidth for this design is approximately 3.3 GHz. The computations were made for an initial setting, with the connector fully engaged and for a final setting where the connector is disengaged by 8 mils. The 8 mil separation was chosen arbitrarily for the purpose of measurement only. In actual practice, the separations would be only a few microinches under mechanical vibrations. The computed phase shift for the 8 mil separation was less than 0.1 degree over a 2.5 GHz bandwidth, and less than 0.025 degrees over a 1.5 GHz bandwidth. The conventional connector would produce a 2.5 degree phase shift for the same separation. The new design would therefore provide better than a 100:1 improvement over the conventional connector for the 1.5 GHz bandwidth.

TABLE 1

| FRBQ GHZ | DB(S11) INTL | DB(S11) FINAL | DB(S21) DELTA | ANG(S21) DELTA |
|---|---|---|---|---|
| 6.5 | −12.53 | −11.60 | −0.062 | 0.796 |
| 7.0 | −14.06 | −13.03 | −0.048 | 0.622 |
| 7.5 | −15.79 | −14.42 | −0.037 | 0.465 |
| 8.0 | −17.85 | −16.46 | −0.027 | 0.327 |
| 8.5 | −20.44 | −18.68 | −0.020 | 0.209 |
| 9.0 | −24.02 | −21.54 | −0.113 | 0.112 |
| 9.5 | −30.04 | −25.67 | −0.007 | 0.039 |
| 10.0 | −69.59 | −33.48 | −0.002 | −0.007 |
| 10.5 | −30.22 | −40.69 | 0.004 | −0.023 |
| 11.0 | −24.12 | −28.11 | 0.010 | −0.006 |
| 11.5 | −20.51 | −23.18 | 0.018 | 0.052 |
| 12.0 | −17.91 | −20.04 | 0.028 | 0.156 |
| 12.5 | −15.84 | −17.72 | 0.040 | 0.315 |

Figure 3:
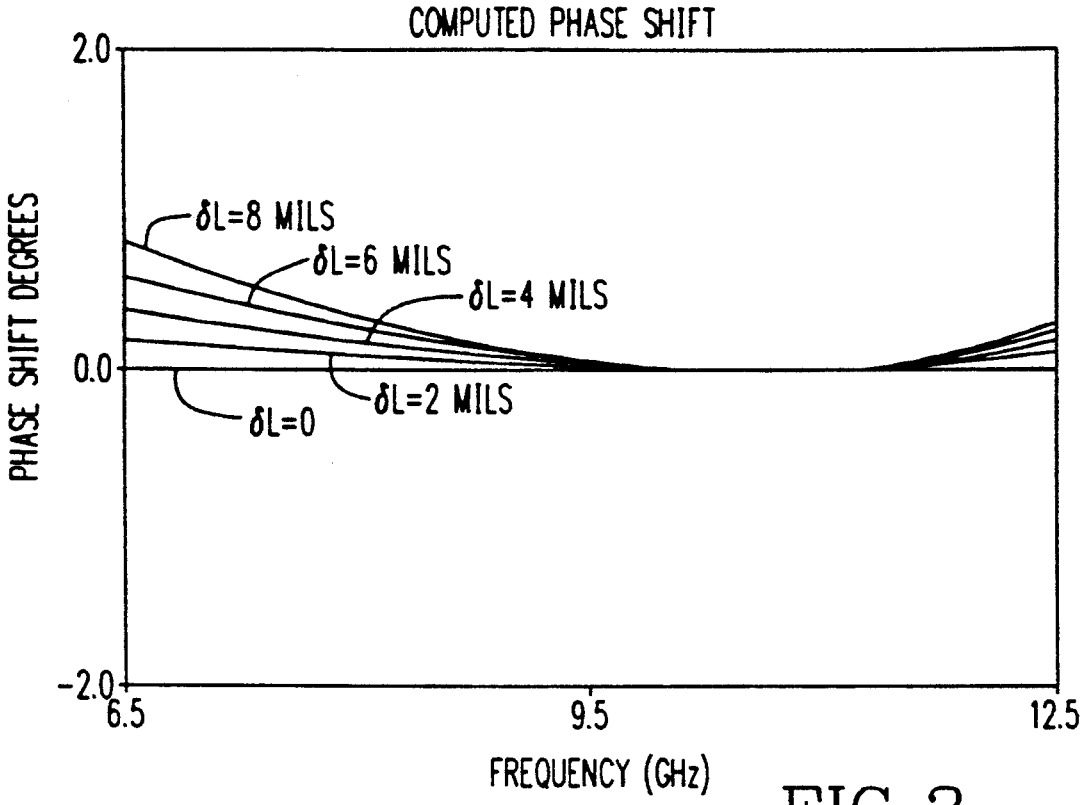
FIG. 3 is a graph showing computed phase shift for the connector of FIG. 2.
Figure 4:
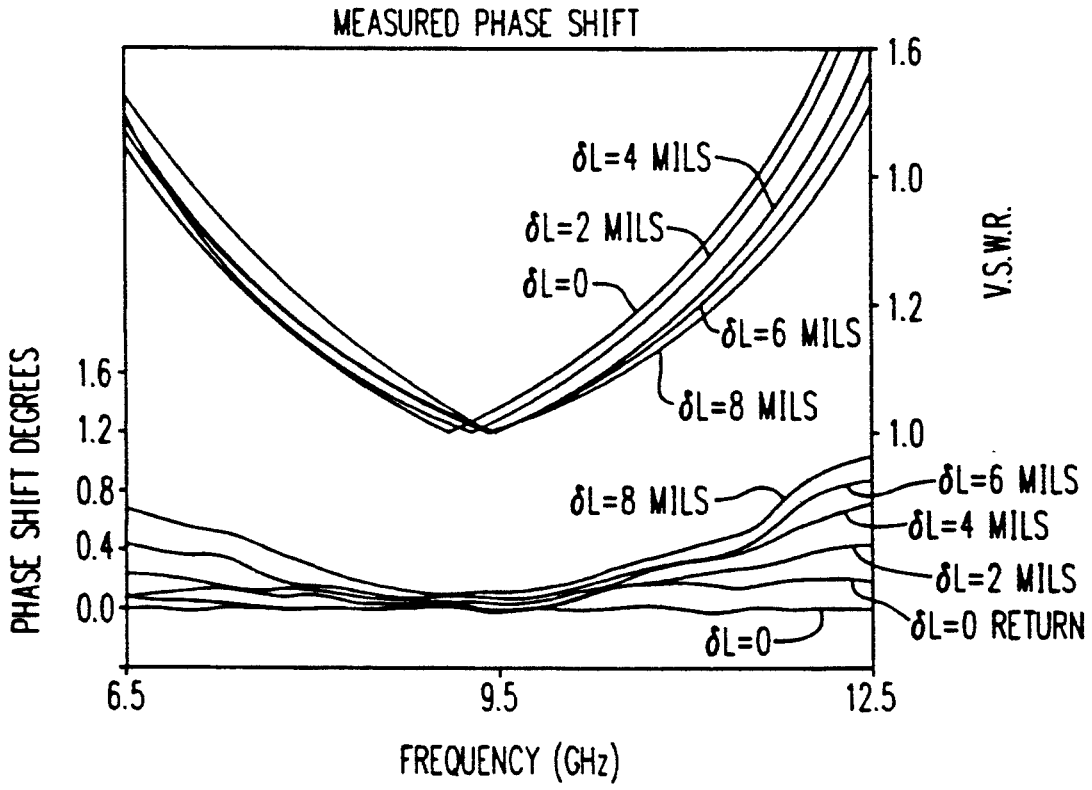
FIG. 4 is a graph showing actual phase shift in a prototype of my connector.

FIG. 3 shows the computed phase shift for the 8 mil separation and for three intermediate settings over the frequency band from 6.5 to 12.5 GHz. FIG. 4 shows the measured results for the prototype connector. The measurements were made from 6.5 to 12.5 GHz for four connector settings, an initial setting where the connector is fully engaged, an 8 mil separation and three intermediate positions. The results compare very well with the computed results of FIG. 3. The maximum phase shift is less than 0.2 degree over a 2.5 GHz band and about 0.1 degree at the band center. The 0.1 degree error is believed to be within the repeatability of the measurement. (The measurement required that each time the connector was set to a new position it was necessary to disconnect and reconnect the test connector to the measurement equipment.) The connector V.S.W.R. measured less than 1.20 over a 30% bandwidth and was virtually matched (V.S.W.R.=1.00) at the band center. The V.S.W.R. response moved in frequency, as predicted, as the connector separated. However, the transmission loss modulation caused by the V.S.W.R. change is small. The A.M. sidebands caused by the loss modulation are significantly lower than the P.M. sidebands, and are usually not of concern. In actual use, the separations would be orders of magnitude less than those in the measurement and the operating band would remain virtually fixed in frequency.

The excellent agreement between the measured and computed results demonstrate that a phase compensated connector can be reliably built to suit particular applications based upon computed performance predictions. Better than a 25 to 1 reduction in the phase shift over the conventional connector was measured with the prototype connector. The actual improvements should be even better since the repeatability of the measurement appeared to be about 0.1 degree. I also believe that the 100:1 improvements that are calculated can be achieved in practice. Potentially the new connector design could improve by as much as 40 dB or better, the P.M. sidebands experienced under mechanical vibrations.

Although I have shown and described certain present preferred embodiments of my connector it should be directly understood that the invention is not limited thereto, but may be variously embodied within the scope of the following claims.

I claim:

1. A motion insensitive coaxial connector comprising;

a male member having a first outer conductor and a first inner conductor coaxial with the first outer conductor, said first inner conductor including a substantially cylindrical body having a major diameter and a substantially cylindrical stub having a minor diameter which stub extends from the body;

a female member having a second outer conductor and a second inner conductor coaxial with said second outer conductor, said second inner conductor including a cavity into which the stub of the male member is inserted, the cavity having a cavity diameter larger than the minor diameter;

the male and female members being connectable to form a gap between a first end of said substantially cylindrical body of said first inner conductor and a first end of said second inner conductor; and a dielectric sleeve positioned within the cavity of the female member, the dielectric sleeve having a first portion and a second portion;

said coaxial connector having characteristic impedances related according to the following equations;

$$Z_{01} = \left(\frac{E_2}{E_1}\right)\cdot\left(\frac{Z_3^2+1}{Z_3}\right),$$

$$Z_1 = \frac{Z_{01}}{\sqrt{\epsilon_1}}, \text{ and } Z_2 = \frac{Z_{01}}{\sqrt{\epsilon_2}};$$

wherein $Z_1$ is the characteristic impedance of a first section of said stub in said first portion of said dielectric sleeve; $Z_2$ is the characteristic impedance of a second section of said stub in said second portion of said dielectric sleeve; $Z_3$ is the characteristic impedance of a third section of said stub in said gap; $Z_{01}$ is the characteristic impedance of said first section of said stub in said cavity if said cavity were filled with air; and $\epsilon_1$ and $\epsilon_2$ are selected dielectric constants of said first and second portions of said dielectric sleeve.

2. The coaxial connector of claim 1 wherein a signal of known wavelength is selected for transmission through the connector and the stub has a length of one quarter of the wavelength.

3. The coaxial connector of claim 1 wherein the dielectric sleeve is comprised of a first sleeve portion formed of a first dielectric material and a second sleeve portion formed of a second dielectric material.

4. The coaxial connector of claim 3 wherein the second dielectric material is air.

5. The coaxial connector of claim 3 wherein the first dielectric material has a first dielectric constant $\epsilon_1$ and the second material has a second dielectric constant $\epsilon_2$ and the male member and female member are sized and the first sleeve portion and second sleeve portion are sized and dielectrically loaded so that $$Z_{01} = \frac{\epsilon_2}{\epsilon_1}\cdot\frac{Z_3^2+1}{Z_3}.$$

6. A motion insensitive coaxial connector comprising;

a male member having a first outer conductor and a first inner conductor, the first outer conductor and the first inner conductor being positioned coaxially, and the first inner conductor including a substantially cylindrical body and a substantially cylindrical stub extending from the body and having a minor diameter;

a female member having a second outer conductor and a second inner conductor, the second outer conductor and the second inner conductor being positioned coaxially, and the second inner conductor including a substantially cylindrical cavity having a diameter larger than the minor diameter;

said male and female members being connectable with respect to each other to form a gap between the substantially cylindrical body of the first inner conductor and an end of the second inner conductor; and a dielectric sleeve positioned within the cavity, the sleeve having a first portion and a second portion, the first and second portions of the dielectric sleeve having different dielectric constants, and wherein, when said male and female members are connected, the stub passes through the gap and the second portion of the dielectric sleeve and extends into the first portion of the dielectric sleeve.

7. A motion-insensitive coaxial connector according to claim 6, wherein a signal of known wavelength is selected for transmission through the connector and the stub has a length of one quarter of the wavelength.

8. A motion-insensitive coaxial connector according to claim 6, wherein the dielectric constant of the first portion of the dielectric sleeve is larger than the dielectric constant of the second portion of the dielectric sleeve.

9. A motion-insensitive coaxial connector according to claim 6, wherein the second portion of the dielectric sleeve is air.

* * * * *